US009745760B2

(12) United States Patent
Pereyra

(10) Patent No.: US 9,745,760 B2
(45) Date of Patent: Aug. 29, 2017

(54) MULTI-FUNCTION BULL FLOAT WITH MODIFIED EDGE OR EDGES

(71) Applicant: Oscar Pereyra, Spring Valley, CA (US)

(72) Inventor: Oscar Pereyra, Spring Valley, CA (US)

( * ) Notice: Subject to any disclaimer, the term of this patent is extended or adjusted under 35 U.S.C. 154(b) by 353 days.

(21) Appl. No.: 14/542,823

(22) Filed: Nov. 17, 2014

(65) Prior Publication Data

US 2016/0138282 A1 May 19, 2016

(51) Int. Cl.
*E04F 21/16* (2006.01)
*E04F 21/24* (2006.01)
*E01C 19/44* (2006.01)

(52) U.S. Cl.
CPC ..... *E04F 21/244* (2013.01); *E04F 21/161* (2013.01); *E04F 21/163* (2013.01); *E04F 21/241* (2013.01); *E01C 19/44* (2013.01)

(58) Field of Classification Search
CPC ..... E04F 21/161; E04F 21/162; E04F 21/163; E04F 21/24; E04F 21/241; E04F 21/244; E01C 19/44
USPC ..... 15/235.4, 235.8; 404/118; D8/45
See application file for complete search history.

(56) References Cited

U.S. PATENT DOCUMENTS 3,936,210 A 2/1976 Oehlerking
4,397,581 A 8/1983 Jarvis
4,520,527 A 6/1985 Maggio et al.
4,723,869 A * 2/1988 Dragich ..... E04F 21/244 15/235.4
4,861,188 A 8/1989 Rouillard
D333,245 S 2/1993 Griggs
5,393,168 A 2/1995 Jarvis
5,737,795 A 4/1998 Murders
6,379,080 B1 4/2002 Saffo, Sr.
6,779,945 B2 8/2004 Saffo, Sr.
6,780,369 B1 8/2004 Darrow et al.
6,923,595 B1 * 8/2005 Chek ..... E01C 19/402 15/235.4
7,059,801 B2 6/2006 Snyder et al.

FOREIGN PATENT DOCUMENTS

CH 699114 * 1/2010
EP 2636818 * 9/2013

OTHER PUBLICATIONS

Partial machine translation of CH 699,114, Jan. 15, 2010.*

* cited by examiner

*Primary Examiner* — Mark Spisich
(74) *Attorney, Agent, or Firm* — Eric Hanscom; Todd J. Langford

(57) ABSTRACT

A bull float for leveling and finishing concrete made from two different materials is disclosed. In one embodiment, the main wooden base has an insert made from fiberglass. As the bull float is pushed forward, the pole is angled such that the wooden back edge levels and smooths the concrete, then on the return stroke the pole is raised such that the fiberglass front edge finishes the concrete as the bull float is swept back to the concrete worker. This bull float performs the tasks currently requiring three separate bull floats, thereby saving the worker from having to replace and clean two or three separate bull floats. As concrete sets up quickly, the time savings obtained through using just a single bull float results in superior concrete slabs with less effort required of the concrete worker and more time to work the concrete.

13 Claims, 8 Drawing Sheets

20
7
30
4
3
2

7

7
31
2
3

20
7
30
2
3

7
2
3

7
31
3
2

MULTI-FUNCTION BULL FLOAT WITH MODIFIED EDGE OR EDGES

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of tools used in the concrete trades, and more specifically toward a bull float with one or more modified edges that can be used to level, smooth and finish concrete. To this end, a bull float with a main body made of wood with at least one additional material used as an insert or an edge is disclosed.

Concrete tools have remained relatively unchanged for decades. The average concrete worker pours concrete into a retained area then initially levels it out with a wooden bull float that is removably attached to the end of a pole. The worker pushes and pulls the bull float across the surface in a back-and-forth motion. After the cement has been leveled, the worker normally removes the wooden bull float from the handle and replaces it with a fiberglass bull float, which is used to further smooth out the concrete and begin to bring the water from the concrete column to the surface, forming a ¼" to ½" layer of "cream" or "paste" on top of the rock. After using the fiberglass bull float, the worker then replaces it with a metal bull float. With each successive bull float, the goal is less to level the concrete surface (which is done very well with a wooden bull float), and more toward bringing more of the buttery paste, or "cream" to the surface. The overall goal of the "floating" process is to first, push down the rock and smooth the concrete so that it is level, and second, create a workable paste that brings air bubbles to the surface of the concrete and allows it to be smoothed.

While this tried-and-true method has been used to create literally millions of concrete slabs throughout the world, the time spent removing one bull float from the pole and replacing it with another is undesirable. Concrete sets up quickly, leaving only a limited amount of time to "work" the concrete before it dries beyond the point where it can be modified further. Indeed, because of the chemical reactions that occur in freshly poured concrete, if it is not properly "worked" while wet and fresh, it is sometimes impossible to fix the problems during the next stage of work. And although in theory a competent concrete worker can swap one bull float or another, the "used" bull float needs to be cleaned and stored, and the worker may have to clean his/her hands or do something else that requires time. The current method also requires a concrete worker to bring a minimum of two—and usually three—bull floats, which requires extra storage space, and takes extra cleaning time. There is also the danger that a worker will bring bull floats with different types of head, and will forget to bring the proper adaptor for each bull float.

A second major problem with having to exchange bull floats occurs when a worker is trying to float a large area or is "locked out" by geographical barriers. For large bodies of concrete that are more than two times as wide as the pole, the worker normally walks in the concrete to float the center, then gradually retreats back toward the edges, working the section that he/she stood in from outside the forms. Obviously, once the worker has floated an entire slab with a wooden bull float, it makes no sense to walk all over the floated surface just to get to the center portion again with a fiberglass and/or metal bull float. "Lock out" occurs when the slab to be poured has physical barriers, such as walls, fences, or other obstacles that prevent the workers from getting access to a section of concrete once they have floated it with a wooden bull float. In both the "large slab" and "lock out" scenarios, the main problem is not the time it takes to exchange bull floats of different materials, but rather the fact that the workers cannot physically access portions of the concrete after the first stage using a wooden bull float. The result is that the air bubbles in the concrete are not brought to the surface, but rather remain in the concrete and weaken it considerably over time.

Thus there has existed a long-felt need for a single bull float that is adaptable to any type of pole, and can effectively perform the functions of wooden, metal, and fiberglass bull floats.

The current invention provides a solution to this problem by creating a bull float made from more than one material, such that the user need only use a different part of the bull float to effectively float a concrete slab without having to worry about "lock out" or large slab size. The worker can retreat across a concrete job, leaving behind a flattened and finished concrete surface that otherwise would require at least two separate bull floats.

The invention saves time, as no longer does the worker have to exchange bull floats. It also provides a superior finished product as the worker can both level and finish a portion of a concrete slab before moving on to another; never having to return to that section to "finish" it further before the floating stage is completed.

A preferred embodiment of the invention has an inserted trailing edge made of fiberglass, but other possible embodiments include two inserts of different materials and having the insert or inserts be thin strips placed into routed indentations in the bottom of the bull float, or entire side pieces adhered to the edge of the bull float, where the side piece extends from the bottom to the top of the bull float. A number of different possible materials are contemplated for the edge or insert, including but not limited to aluminum, magnesium or other metals, fiberglass, plastic, composite material, or even wood of a different density. Possible combinations in the embodiment of the invention that have the base unit of wood combined with inserts or side pieces where the insert or side piece is on only one side of the base, and where there are two inserts or side pieces—one on either edge of the base. Various combinations of material from which the inserts and side edges are made include wood fiberglass, wood/metal, fiberglass/wood/metal, wood/plastic, plastic/wood/metal and others. It should also be noted that while the main metals contemplated are aluminum and magnesium, other suitable metals are contemplated.

SUMMARY OF THE INVENTION

The current invention provides a solution to the prior art problems of both time waste through exchanging multiple bull floats and those caused by large slabs and lock-out by having a wooden bull float made from more than one material. One embodiment of the invention calls for a wooden base with a fiberglass insert inserted into a similarly size slot on the trailing edge. As the bull float is being pushed away from the worker, the wooden portion of the bull float levels and smooths out the concrete. As the worker pulls the bull float back, the fiberglass insert finishes the concrete. Another embodiment calls for a strip of a second material to be attached to the edge of a bull float, where the strip is of the same height as the main body of the bull float.

A particularly preferred embodiment of this version of the invention has a wooden bull float with a fiberglass edge. The edge is generally created in two possible forms. First, a slot can be routed into the wood base, and a fiberglass insert the same height, length and width as the slot can be inserted into the slot and secured in place. Second, an entire strip of fiberglass can be attached to one edge of the wooden base. The advantage of the first version is that it will take less of the expensive fiberglass material. The advantage of the second version is that from time to time bull floats are sanded to make sure the bottom is perfectly flat, thus there is no danger that repeated sandings will eventually wear away the thin fiberglass strip.

It is a principal object of the invention to provide a single bull float that can perform the functions of wooden, metal, and fiberglass bull floats.

Another object of this invention is to provide a single bull float with two or more different materials for working concrete during the floating stage such that the concrete worker does not have to exchange bull floats made from a single material with another bull float of a single material, or have to re-enter a locked-out location or a slab that is so wide worker cannot float the center of slab without walking back over the concrete he/she has just been working on.

It is a further object of the invention to provide a means by which a concrete worker can avoid the problems of "lock out" on a job site.

Another object of the invention is to prevent the problem a concrete worker faces when trying to float a large area of concrete where after floating the entire slab with a wooden float, he/she has to either not work the center portion that is not reachable with a pole, or walk all over the previously floated section to access the central portion.

It is another object of the invention to provide a means for finishing a slab or other working unit of concrete using a single bull float, thereby avoiding the need to switch different types of bull floats in the middle of a job.

Another object of the invention is to avoid the necessity of cleaning multiple bull floats in the middle of a concrete job.

A further object of the invention is to avoid having to haul more than one bull float along on a job.

Another object of the invention is to provide a superior concrete slab that avoids the problem of Plastic Shrinkage Cracking, which is cracking that occurs in the surface of freshly poured concrete that has not been properly worked, as can happen when a worker using the prior art method of two or three separate bull floats cannot work a section of the slab with a second bull float because he/she is either "locked out" or does not have pole long enough to effectively work the center of a large slab.

It is a final object of this invention to provide a bull float that creates a concrete slab or other unit of concrete that is superior to that created utilizing the prior art as the work can devote 100% of his/her time to working the concrete without have to spend time swapping out different types of bull floats and cleaning each when it has performed its step of the process.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
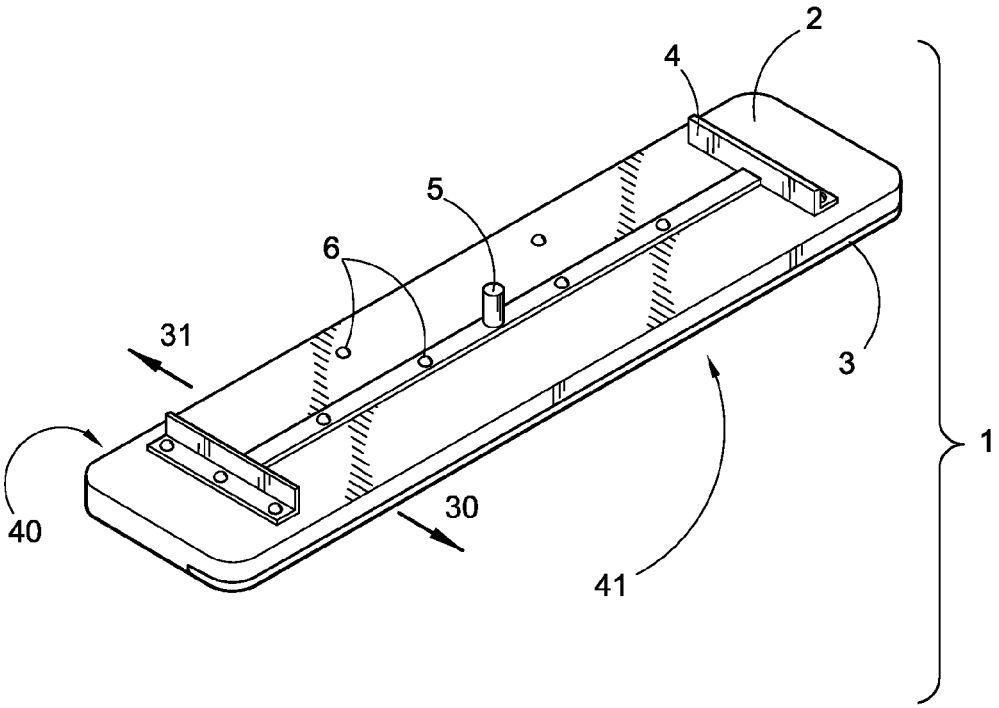
FIG. 1 is a perspective view of a multi-function bull float according to the current invention.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

REFERENCE NUMBERS

7. Invention
8. Base
9. Insert
10. Bracket
11. Pole attachment site
12. Means of attachment
6A. Means of attachment between insert and base
8. Starter Connection Adaptor/bracket, can be found in two types: Spring button snap lock, or, threaded.
9. Swivel nut adaptor
10. Tilt/pivot twisting mounting adaptor
20. Concrete Worker
30. Direction of pulling invention back
31. Direction of pushing invention forward
40. Back Edge
41. Front Edge.
300. Strip FIG. 1 is a perspective view of a multi-function bull float according to the current invention. The bull float, generally referenced as 1, has a base 2, an insert 3, a bracket 4, a pole attachment point 5, and means of attachment 6. The base and insert can be made from any suitable material, with the goal of allowing a single bull float to perform more than one function. In a preferred embodiment of the invention, the base is made of wood, as is a standard wooden bull float. Wooden bull floats are generally used in the first stage of floating a concrete job, where the goal is to level the concrete. The base has a front edge 41 and a back edge 40; the front edge faces in the direction of a push; the back edge faces in the direction taken when the concrete worker pulls back on the invention. On the front edge 41, a slot has been made with a router or other cutting device to allow an insert 3 to be attached. The insert is made of fiberglass or some other material such as aluminum, blue steel or magnesium that leaves a slick and smooth surface to a slab of concrete. Thus, when the invention is being pushed forward the front edge 41 is "leading"; as the invention is being pulled back toward the worker, the back edge 40 is "leading". It should be noted that in some circumstances, the bull float will be preferably reversed. For example, when floating a steeply sloped slab of concrete, it is not desirable to have a return stroke, or "pull back", as these tend to drag undesirable amounts of concrete down the slope. So, for these types of jobs, the bull float would be reversed such that the fiberglass edge would be "trailing" during a "push", rather than a "pull back".

The insert 3 is attached to the base 2 by screws or other known means of attachment (not shown in this figure). To attach the bull float to a pole, there are several means contemplated. First, the bull float could attach directly to the end of the pole through screws, bolts or other known means. Second, a bracket 4 could be used to not only provide structure to the base, but also to provide the connection to the pole. The bracket 4 serves to mount the pole attachment point 5 in a location where a pole (not shown in this figure) can be conveniently attached, and to support the base 2. The bracket 4 is attached to the base 2 by means of attachment 6 such as screws, bolts, or pop rivets. It is contemplated that a number of different bracket designs could be used with this invention, including the "H" shaped one shown in the figures, various meshes, a rectangular one that covers the edges of the bull float, and a straight one that is merely a single member extending horizontally down the bull float.

The method of use of this invention will be detailed in FIGS. 10A-10F, which are sequential views, but what can be seen from this figure is that when the bull float is pushed forward 30, it naturally lists backwards such that the wooden portion of the base 2, the back edge 40, is flattening the concrete, and when it is pulled back 31, the fiberglass insert 3 on the front edge 41 has become the "trailing edge" and is smoothing the surface and providing the final finishing effect to the concrete during the "floating" stage. It should be noted that after the floating stage, there are additional steps needed to completely finish laying a concrete slab; this invention just decreases the time and increases the quality of the stage in which the worker floats the slab.

Figure 2:
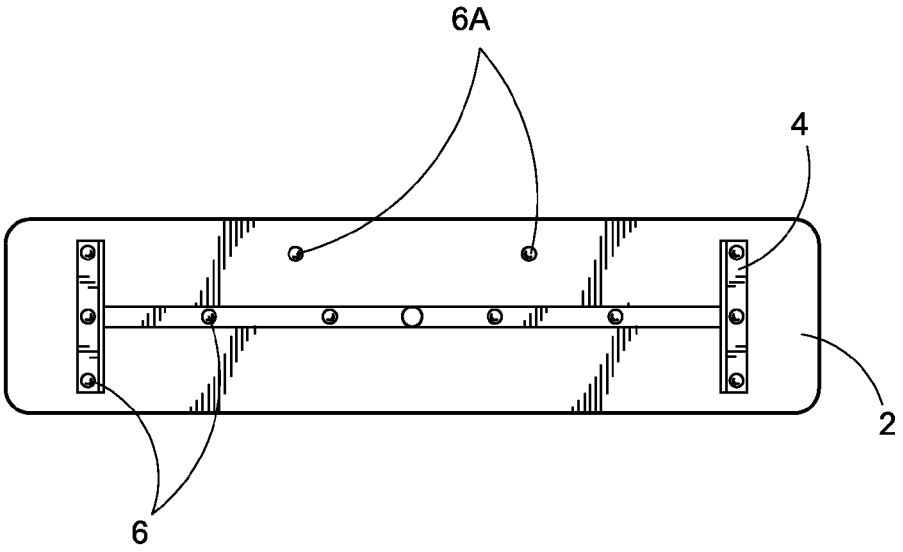
FIG. 2 is a top view of a multi-function bull float according to the current invention.

FIG. 2 is a top view of a multi-function bull float according to the current invention. The bracket 4 is attached to the base 2 by screws or other means of attachment 6. It should be noted again that the bracket is not necessarily essential to the invention—the pole could attach directly to the base portion of the bull float—and that brackets of different shapes and sizes are contemplated.

Figure 3:
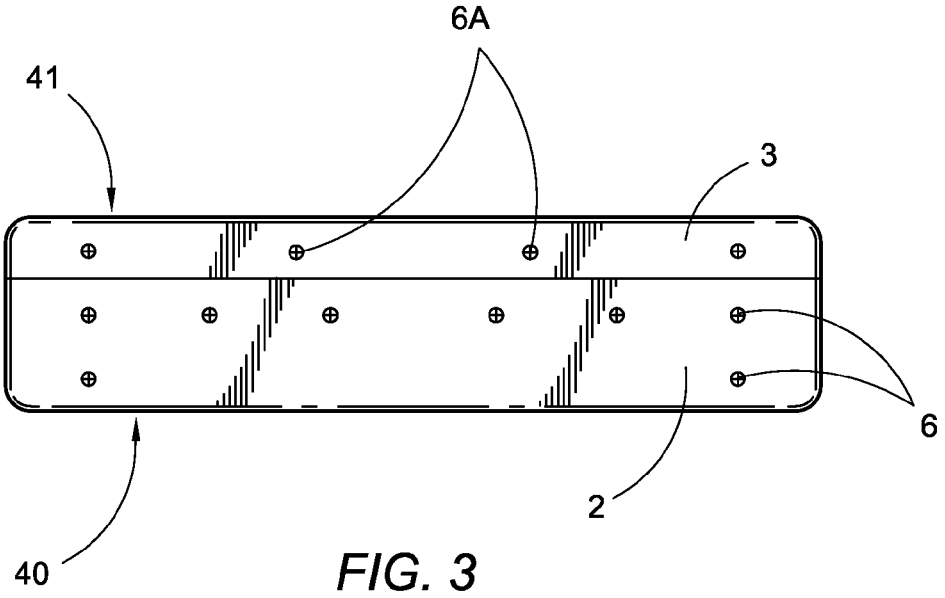
FIG. 3 is a bottom view of a multi-function bull float.

FIG. 3 is a bottom view of a multi-function bull float. The screws or other means of attachment 6 reflect the shape of the bracket (not shown in this figure), and show how both the base 2 and the insert 3 are attached to the bracket, with one or more additional screws or other means of attachment 6A providing additional means of attachment between the insert 3 and the base 2. This figure also gives a bottom perspective on a preferred embodiment of the bull float as it is pushed forward, such that it's front edge (fiberglass) 41 is leading the way and the back edge (wood) 40 is trailing behind and leveling the concrete. As the worker stops pushing and starts pulling back on the invention, the worker can change the angle of the invention such that the back edge is higher than the front edge, such that the main contact between the invention and the surface of the concrete is the fiberglass insert 3.

Figure 4:
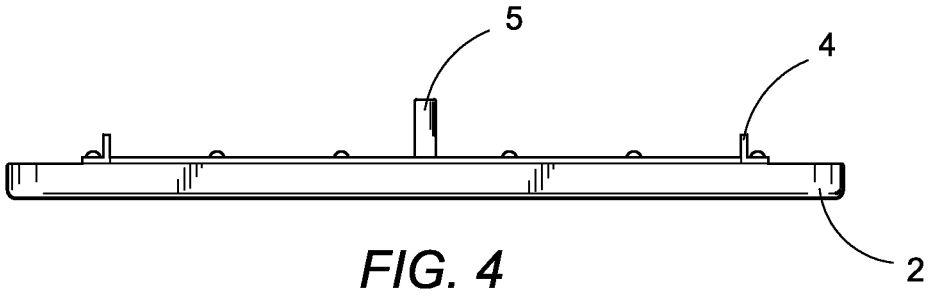
FIG. 4 is a back view of a multi-function bull float.

FIG. 4 is a back view of a multi-function bull float, showing the projection of the pole attachment site 5, and the structural portions of the bracket 4 as it supports the base 2.

Figure 5:
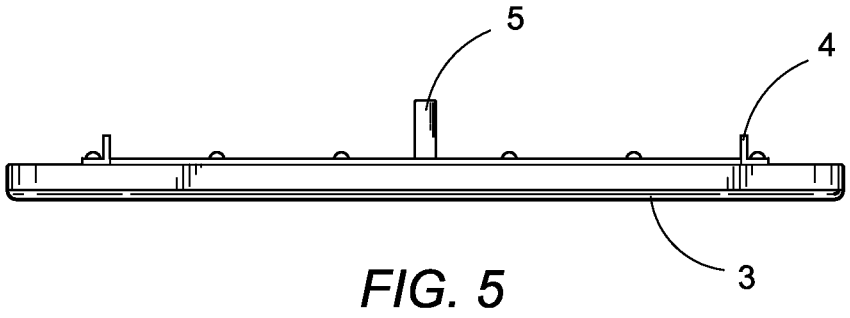
FIG. 5 is a front view of a multi-function bull float.

FIG. 5 is a front view of a multi-function bull float, showing the projection of the pole attachment site 5, and the structural portions of the bracket 4 as it supports the base 2 and the insert 3.

Figure 6:
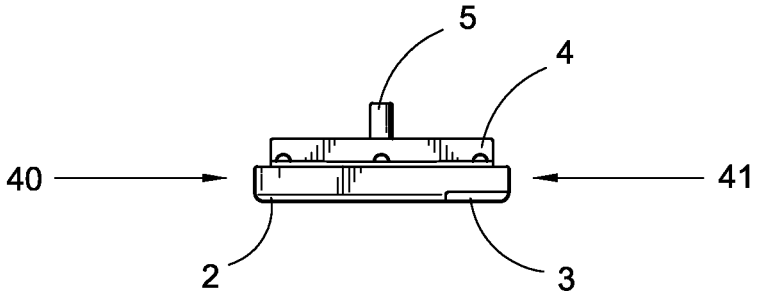
FIG. 6 is a side view of view of a multi-function bull float.
Figure 7A:
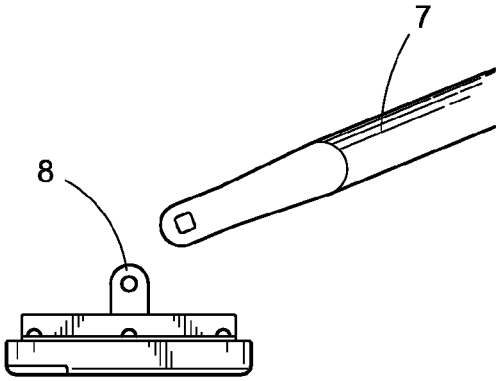
FIGS. 7A, 7B, 8A, 8B, 9A and 9B are side views of several means of attachment between view of a multi-function bull float and a pole, and show the two main methods of use.
Figure 8A:
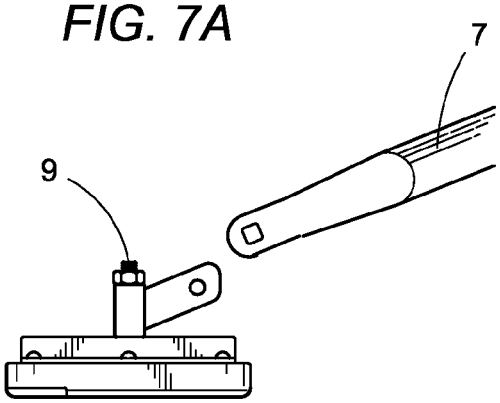
Figure 9A:
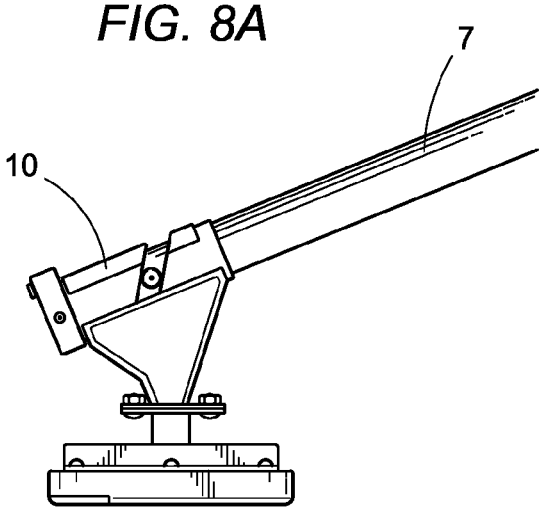
Figure 7B:
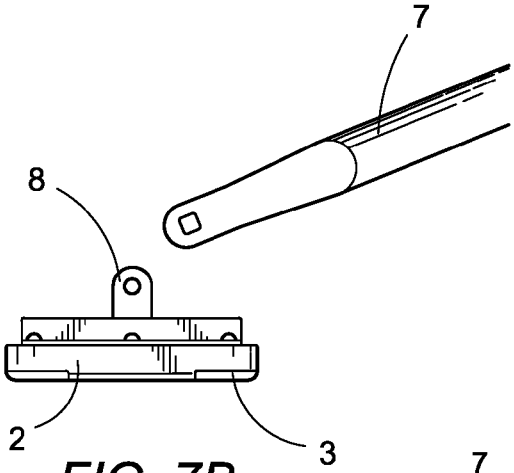
Figure 8B:
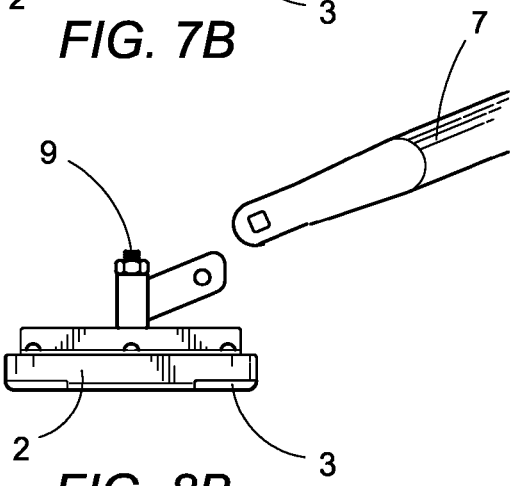
Figure 9B:
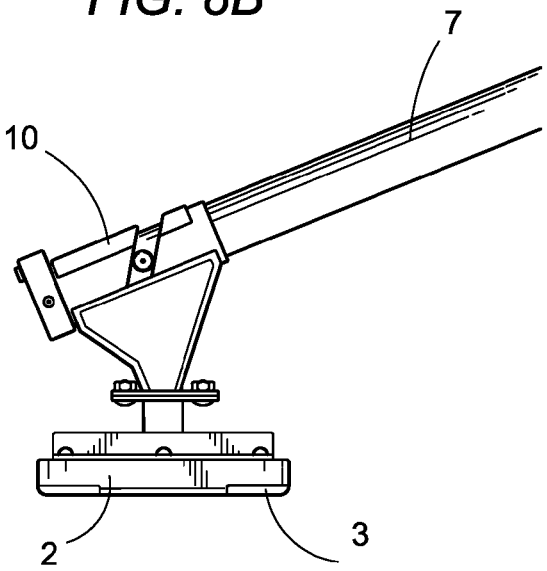

FIG. 6 is a side view of view of a multi-function bull float, showing the projection of the pole attachment site 5, and the structural portions of the bracket 4 as it supports the base 2 and the insert 3.

FIGS. 7A, 7B, 8A, 8B, 9A and 9B are side views of several means of attachment between view of a multi-function bull float and a pole 7, and show the two main methods of use. The main methods of connection are the Starter Connection Adaptor/bracket, 7A, which can be found in two types: Spring button snap lock, or, threaded, the Swivel nut adaptor 8A, and the Tilt/pivot twisting mounting adaptor 9A.

With most concrete jobs, the bull float will be positioned with the insert 3 facing away from the worker. For some conditions, however, particularly with steeply sloped concrete slabs, the work will reverse the bull float as a "pulling" stroke is not desirable as it tends to pull the concrete down the slope.

These figures also illustrate an embodiment of the bull float in which there are two separate inserts, one on each edge of the bull float. In this embodiment of the invention, the wooden base can still perform its normal job of leveling the concrete, while there are two separate edges to perform different functions. For example, one edge could be fiberglass and the other metal.

FIGS. 10A, 10B, 10C, 10D, 10E and 10F are sequential views of a concrete worker using the invention to level and finish a concrete slab showing the two main methods of use. As seen in FIG. 7, the bull float can be attached to the pole through a variety of means. With each of the means of attachment, there is some sort of tightening mechanism that allows the concrete worker 20 to adjust how much tension there is on the bull float, such that the worker can tighten the connection to the point where the angle of the bull float on the concrete can be adjusted by changing the angle between to pole and the concrete.

A common method of leveling and finishing concrete is to "push" the bull float out, in direction 30, where the pole in a "lowered" position 10A, such that the back edge of the base 2 forms a straight barrier and helps to even out the concrete. Once the bull float has been pushed out as far as the pole can go, the worker raises (or twists, in the case of 9A) the pole 10B to flatten the bull float so the entire bottom sits on the concrete, then raise it further 10C to create a significantly greater angle between the surface of the concrete and the pole, then "pulls" back on the pole. Because of the greater angle between the surface of the concrete and the pole, the front edge of the bull float with the insert 3 is now in contact with the surface of the concrete and smooths out the surface as it is pulled back. While the wooden portion generally is used to level out the concrete slab, the fiberglass or in some cases metal, is used the create a thin level of "butter", "cream", or "paste", which is a layer in the upper ¼" to ½" of the concrete slab, which can be further worked to remove the air bubbles and leave a clean, smooth surface.

Figures 10A, 10B, 10C:
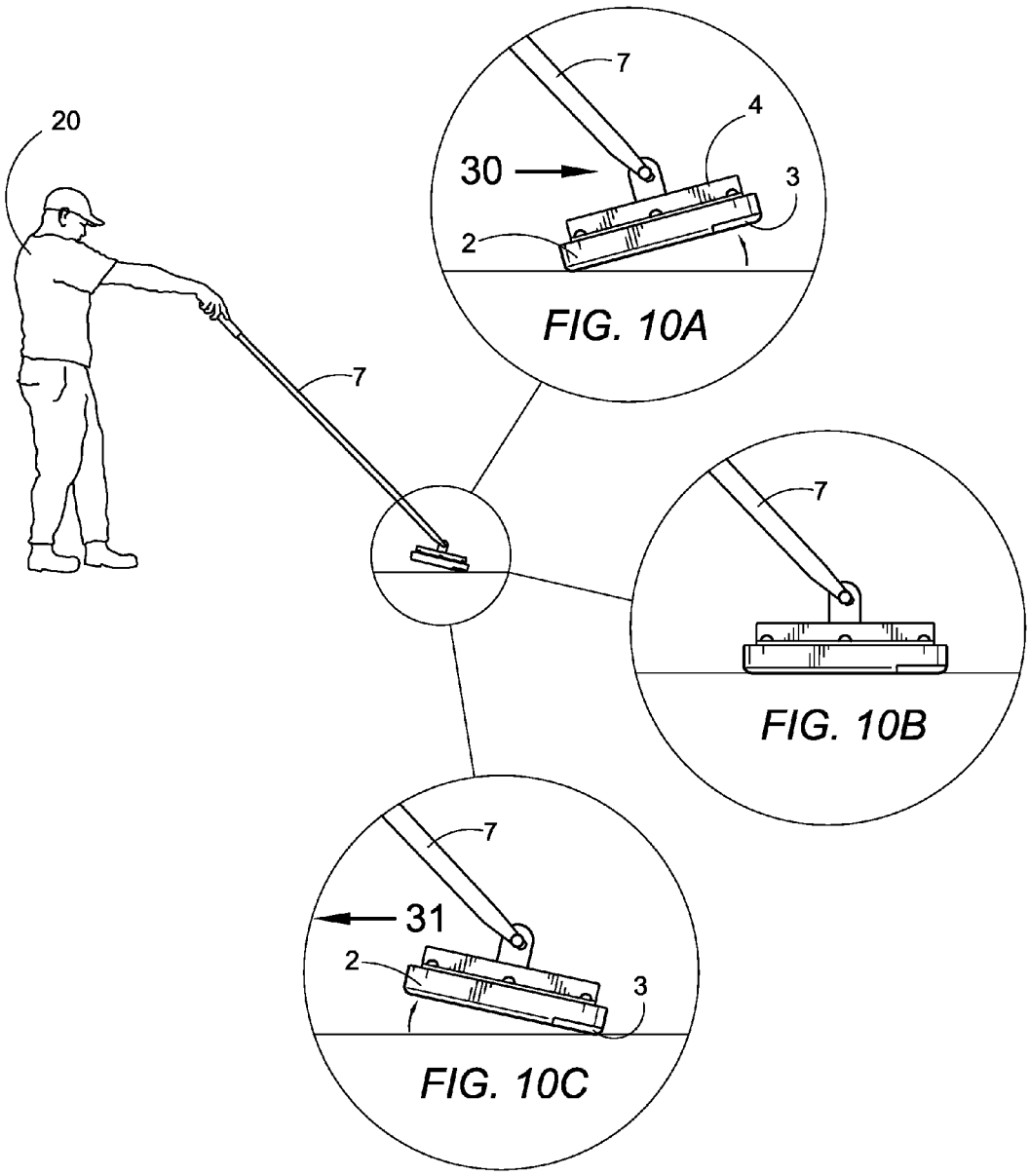
FIGS. 10A, 10B, 10C, 10D, 10E and 10F are sequential views of a concrete worker using the invention to level and finish a concrete slab showing the two main methods of use.
Figures 10D, 10E, 10F:
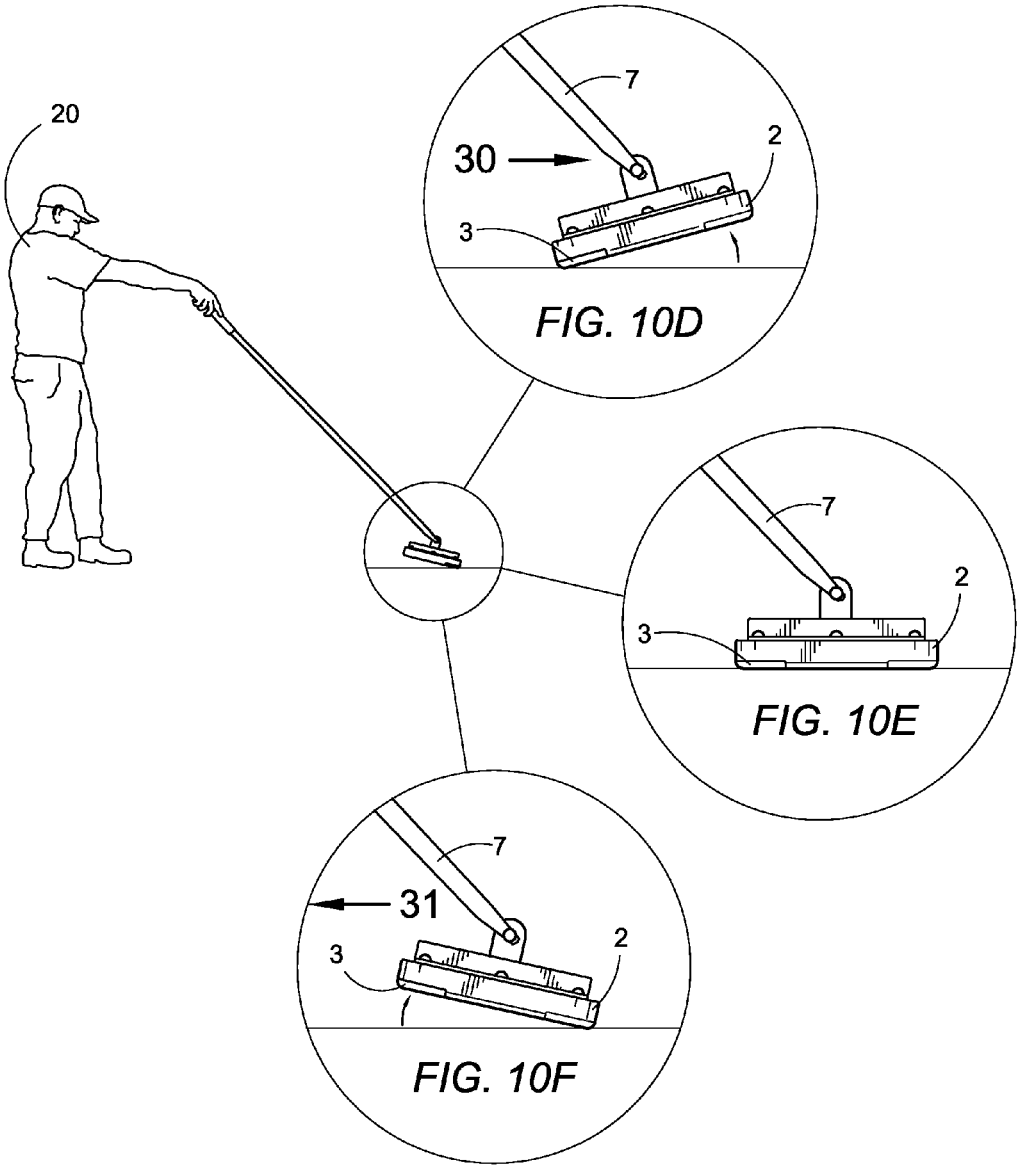
Figure 11A:
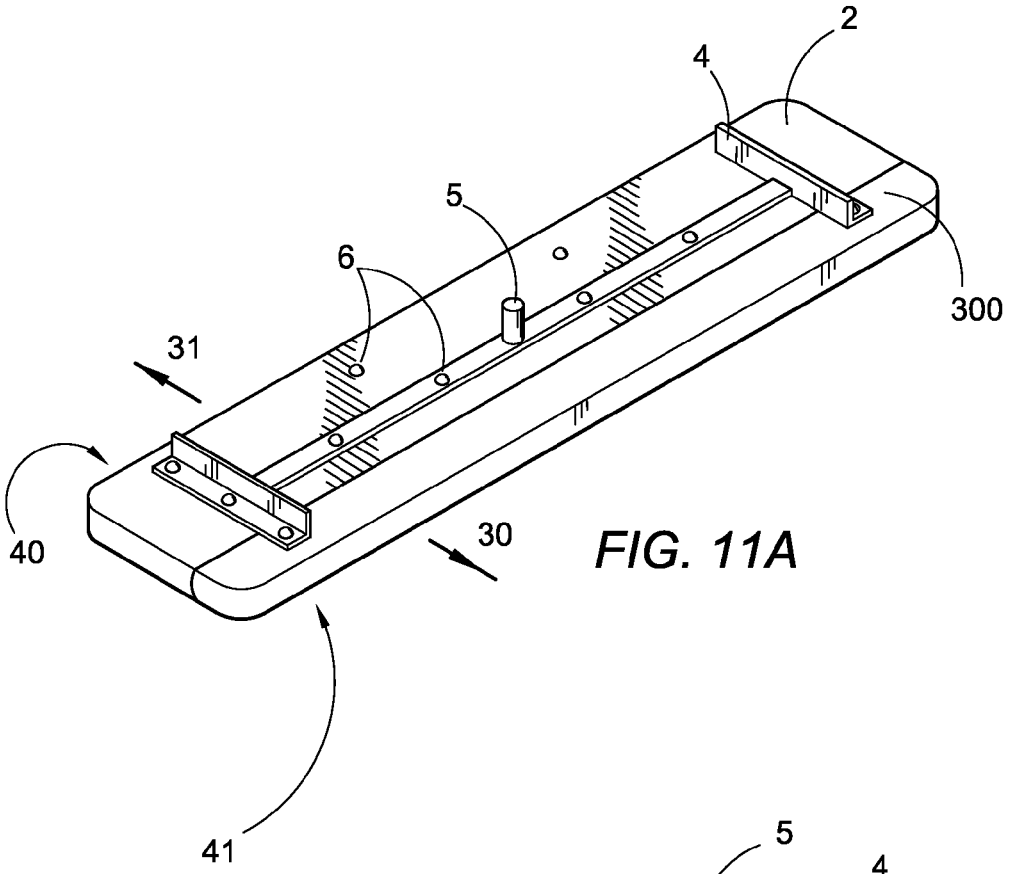
FIGS. 11A and 11B show the "strip" version of the invention where a strip of a different material is added to the edge of the base.
Figure 11B:
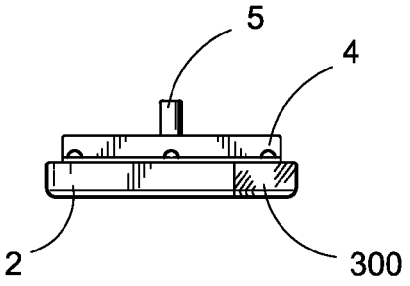

FIGS. 10D through 10F show a worker 20 using the bull float in the opposite direction, where on a push, the insert 3 is in contact with the concrete and on the pull, the base 2 is in contact. This method is sometimes used in situations where it is undesirable to pull back on the float. For example, when the worker is floating a steeply sloped slab, it is undesirable to pull back on the bull float for fear it will pull down some of the concrete. This figure also illustrates the option of placing an insert on both the leading and trailing edge. For example, the leading edge insert (not identified by a reference number) could be fiberglass and the trailing edge insert (3) could be metal. Using this version of the invention, the worker could use the wooden portion to level the concrete, then the two inserts to remove the air bubbles, create the paste layer, and finish the floating portion of the job—all with only a single bull float.

With the prior art, the worker has to stop working at least once to swap bull floats, as the fully wooden bull float that is used as the first working tool in the currently used method of working a concrete slab is good mainly for leveling out the surface of the concrete, but the final finishing is done with one or more separate bull floats made of different materials. With most concrete work, the worker has to break from work twice, first to remove the wooden bull float and install a metal one; second, to remove the metal one and install a fiberglass one. With the current invention though, there is no need to swap out (and clean) different bull floats, as this invention performs all the tasks that currently require three bull floats.

Two other major problems presented to concrete workers are the Lock Out and access problems. With a large slab, the worker who has floated the slab with a wooden bull float may not have a long enough pole to reach the center of the slab with the second bull float. Thus, the alternatives are to either leave the center unfinished, which creates problems with the quality of the slab, or to tromp through the already worked concrete along the edges of the slab to reach to the center to work that section with the proper bull float, then re-float the edges that were trodden. This is obvious unsatisfactory as it will take additional time to re-do the area where the worker had to walk, and concrete has a limited amount of time during which it can be worked.

The lock out problem is equally challenging, and occurs when the slab to be poured has physical barriers such as walls that prevent the worker from finishing a section that was already worked with a wooden bull float. Concrete workers often work by backing up and working successive patches of concrete as they back toward the edge of the slab. If there is a barrier to prevent them from getting back to the area in which they started, they cannot work the area with another bull float of a different material, leaving them with the same equally undesirable choices as in the access situation above.

With either scenario, the worker who doesn't finish the floating with more than one bull float leaves a weak area, full of air bubbles, while the worker who steps back into already floated concrete wastes valuable time re-finishing the section in which he/she walked. In either case, by the time the worker is ready for the next phase of finishing the concrete, the Kneeboard or sliders $2^{nd}$ stage, it may be too late in the concrete hardening process to effectively start working the concrete, resulting in air bubbles, which will eventually become shrink cracks.

With the current invention, a worker needs only push and pull a few times and the concrete surface is finished for this stage, and the worker can move to the next section immediately. During the push, the wooden back edge flattens and levels the concrete. On the pull back, the fiberglass front edge butters the surface, pulling water and air to the surface, creating a cream or paste above the rock, and leaving a smooth, attractive finish to the concrete.

Thus, a considerable amount of time is saved, which is extremely valuable in the concrete trade, as concrete has a limited amount of time during which it can be manipulated before it sets. Once concrete sets, or hardens, it becomes unworkable and even the most skilled concrete worker cannot level out any bumps or provide a smooth finish to the slab. Should concrete harden before it is properly worked, one of two things usually happens. The professional concrete worker will have to tear out the entire slab and start all over. The less professional concrete worker will put a thin coat of "finish" cement over the improperly worked slab, which will mask the air pockets and other defects in the slab for a month or two, before the cracks start appearing through the finish (and the hack concrete worker is long gone).

As such, saving time in the concrete trade equates to saving money and providing a superior product, benefitting the concrete workers, the customers, and the general reputation of the concrete trade.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A bull float comprising: a base, an insert, a bracket, a pole attachment point, one or more insert attachment devices, one or more bracket attachment devices, and a pole attachment device, where, the base comprises from a top view a cuboid piece of wood with an upper surface and a bottom surface, two long-side surfaces and two short-side surfaces, where the bottom surface has a front edge and a back edge, where a slot has been created in the bottom surface, at the front edge of the bottom surface, where the slot has a height, a width and a length, and where the insert has a height, a width, and a length that is the same size as the height, width and length of the slot, and where the insert is inserted into the slot and secured to the base by means of the one or more insert attachment devices, where, after the insert is inserted into the slot, a bottom surface of the insert forms a flush, continuous plane with the bottom surface of the base, where the one or more insert attachment devices and the one or more bracket attachment devices are screws, where the bracket comprises a roughly "H" shaped metal structure with two members aligned in a direction of from the front edge to the back edge, and a member that connects the two members which is aligned parallel to the front edge and the back edge, and where the bracket is connected to the base by the one or more bracket attachment devices, where the bracket is connected to the pole attachment point, where the pole attachment point is capable of receiving a pole, and, where a pole can be connected to the pole attachment point with the pole attachment device, and the bull float can be pushed in a forward direction by a worker attempting to finish a concrete slab or other area of concrete, such that by adjusting the angle of the base, when pushing the bull float in a forward direction, away from the worker, the front edge can be slightly raised, thereby allowing the back edge to level the concrete, and when the worker retrieves the bull float by pulling it back in a back direction, by adjusting the angle of the base the front edge will be lower than the back edge such that the insert will be the last part of the bull float to touch the concrete, and where the insert can smooth and finish the concrete.

2. A bull float comprising: a base, a first insert, and one or more insert attachment devices, where the one or more insert attachment devices attach the insert to the base, where, the combination of the insert and base create a modified bull float, where, the modified bull float comprises from a top view a cuboid device with an upper surface and a bottom surface, two long-side surfaces and two short-side surfaces, where the bottom surface has a front edge and a back edge, where the base has a bottom surface and where the insert has a bottom surface, and where the base is made from a first material and the insert is made from a second material, and where the first material is not the same as the second material, and where, after the insert is attached to the base, the bottom surface of the insert forms a flush, continuous plane with the bottom surface of the base, additionally comprising a second insert, where the second insert is made from a third material, and where the third material is different from the first material and different from the second material, where the base has a cuboid shape, the first insert has a cuboid shape, and the second insert has a cuboid shape, and where the second insert and the first insert are located opposite each other on the respective front and back edges of the base.

3. The bull float of claim 2, where the base is larger than the first insert, and the base is larger than the second insert.

4. The bull float of claim 3, additionally comprising a pole attachment point and a pole attachment device, where the pole attachment point is capable of receiving a pole, where a pole can be connected to the pole attachment point with the pole attachment device, and the bull float can be pushed in a forward direction by a worker attempting to finish a concrete slab or other area of concrete, such that by adjusting the angle of the base, when pushing the bull float in a forward direction, away from the worker, the front edge can be slightly raised, thereby allowing the back edge to level the concrete, and when the worker retrieves the bull float by pulling it back in a back direction, by adjusting the angle of the base the front edge will be lower than the back edge such that the first insert will be the last part of the bull float to touch the concrete, and where the first insert can smooth and finish the concrete.

5. The bull float of claim 4, additionally comprising a bracket and one or more bracket attachment devices, where the one or more insert attachment devices and the one or more bracket attachment devices are screws, where the bracket comprises a roughly "H" shaped metal structure with two members aligned in a direction of from the front edge to the back edge, and a member that connects the two members which is aligned parallel to the front edge and the back edge, and where the bracket is connected to the base by the one or more bracket attachment devices, and where the bracket is connected to the pole attachment point.

6. The bull float of claim 2, where the first material is wood and the second material is fiberglass.

7. The bull float of claim 2, where the first material is wood, the second material is fiberglass, and the third material is metal.

8. The bull float of claim 2, where a slot has been created in the bottom surface of the base, at the front edge of the bottom surface, where the slot has a height, a width and a length, and where the first insert has a height, a width, and a length that is the same size as the height, width and length of the slot, and where the first insert is inserted into the slot and secured to the base by means of the one or more insert attachment devices, where, after the first insert is inserted into the slot, a bottom surface of the first insert forms a flush, continuous plane with the bottom of the base.

9. The bull float of claim 8, where two slots have been created in the bottom surface of the base, at the front edge of the bottom surface and at the back edge of the bottom surface of the base, where each of the two slots has a height, a width and a length, and where each of the first insert and the second insert has a height, a width, and a length that is the same size as the height, width and length of the slots, and where each of the first insert and the second insert is inserted into a respective one of the slots and secured to the base by means of the one or more insert attachment devices, where, after the first insert and the second insert are inserted into the two slots, the bottom surfaces of each of the inserts form a flush, continuous plane with the bottom surface of the base.

10. The bull float of claim 9, where the first material is wood and the second material is fiberglass.

11. The bull float of claim 9, where the first material is wood, the second material is fiberglass, and the third material is metal.

12. The bull float of claim 8, where the first material is wood and the second material is fiberglass.

13. The bull float of claim 8, where the first material is wood and the second material is metal.

* * * * *